US005476393A

United States Patent [19]

Narita

[11] Patent Number: 5,476,393

[45] Date of Patent: Dec. 19, 1995

[54] ELECTRICAL CONNECTOR FOR FLAT CABLE

[75] Inventor: Hiroshi Narita, Tokyo, Japan

[73] Assignee: Thomas & Betts Corporation, Memphis, Tenn.

[21] Appl. No.: 223,928

[22] Filed: Apr. 6, 1994

[51] Int. Cl.[6] ..... H01R 9/07

[52] U.S. Cl. ..... 439/495; 439/711

[58] Field of Search ..... 439/711, 341–342, 439/347, 492–499, 259

[56] References Cited

U.S. PATENT DOCUMENTS

| | | | |
|---|---|---|---|
| 3,641,482 | 2/1972 | Bretting | 339/196 |
| 4,068,912 | 1/1978 | Hudson, Jr. et al. | 339/97 |
| 4,209,217 | 6/1980 | Gudaitis et al. | 339/75 |
| 4,515,424 | 5/1985 | Sakurai | 439/259 |
| 4,592,608 | 6/1986 | Ohtsuka et al. | 339/42 |
| 4,630,874 | 12/1986 | Renn et al. | 439/492 |
| 4,647,131 | 3/1987 | Van Woensel | 339/74 |
| 4,863,388 | 9/1989 | Reimer et al. | 439/341 |
| 4,878,853 | 11/1989 | Yamade et al. | 439/144 |
| 4,944,690 | 7/1990 | Imai | 439/492 |
| 5,173,058 | 12/1992 | Broeksteeg | 439/493 |

*Primary Examiner*—Larry I. Schwartz
*Assistant Examiner*—Jill DeMello
*Attorney, Agent, or Firm*—Robert M. Rodrick

[57] ABSTRACT

A connector body member has conductor receiving sections for receiving a plurality of conductive end portions of a member to be connected, such as a flat cable, a jumper, or a printed circuit board. A plurality of contacts are so mounted as to project into the conductor receiving sections in order to contact the conductive end portions of the member to be connected. A cover member for holding the contact between the conductive end portions of the member to be connected and the contacts is formed to be pivotal with respect to the connector body member. Each conductor receiving section has an opening. The cover member pivots to cover the openings of the conductor receiving sections. The cover member is also locked into the connector body member by sliding along the connector body member while covering the openings.

5 Claims, 3 Drawing Sheets

ELECTRICAL CONNECTOR FOR FLAT CABLE

FIELD OF THE INVENTION

The present invention relates to a connector for connecting, e.g., a flat cable and, more particularly, to a connector which allows a flat cable to be vertically placed into or removed from the contacts of the connector.

BACKGROUND OF THE INVENTION

In a conventional connector for connecting a flexible board such as a flat cable, an opening for receiving the cable is formed parallel (horizontal) to the contacts. To connect a flat cable by using the connector of this type, therefore, it is necessary to insert the end portions (electrodes) of the cable into the opening with the end portions arranged in line, horizontally move the cable, and push the cable to the positions of the contacts.

In this case, it is common practice to solder the end portions of the contacts away from the cable to, e.g., a printed circuit board. Therefore, if a larger force than is necessary is applied to the contacts when the cable is moved, the contacts may be deformed or broken. In addition, the cable itself may also be deformed or broken under an excess load. Furthermore, it is not easy to insert the end portions of the cable into the opening of the connector with the end portions arranged in line, especially when the length of the cable is short.

SUMMARY OF THE INVENTION

To solve the above problems, a connector according to the present invention allows a cable such as a flat cable, to be vertically placed into or removed from contacts of the connector, thereby making easy insertion and removal possible without applying load on the cable.

More specifically, the connector of the present invention comprises a connector body member with conductor receiving sections for receiving a plurality of conductive end portions of a member to be connected, such as a flat cable, a jumper, or a printed circuit board. A plurality of contacts so mounted project into the conductor receiving sections in order to contact the conductive end portions of the member. A cover member is formed to be pivotal with respect to the connector body member and maintain contact between the conductive end portions of the member and the contacts. The conductor receiving sections have openings for placing the conductive end portions of the member and bringing them into contact with the contacts.

After a flat cable or the like is placed in the openings of the conductor receiving sections of the connector, the cover member is pivoted to bring the conductor portions of the cable into contact with the contacts mounted inside the connector. Subsequently, the cover member is locked into the connector body member by sliding the cover member along the connector body member such that the cover member keeps covering the opening.

DETAILED DESCRIPTION OF THE PREFERRED EMBODIMENTS

Figure 1:
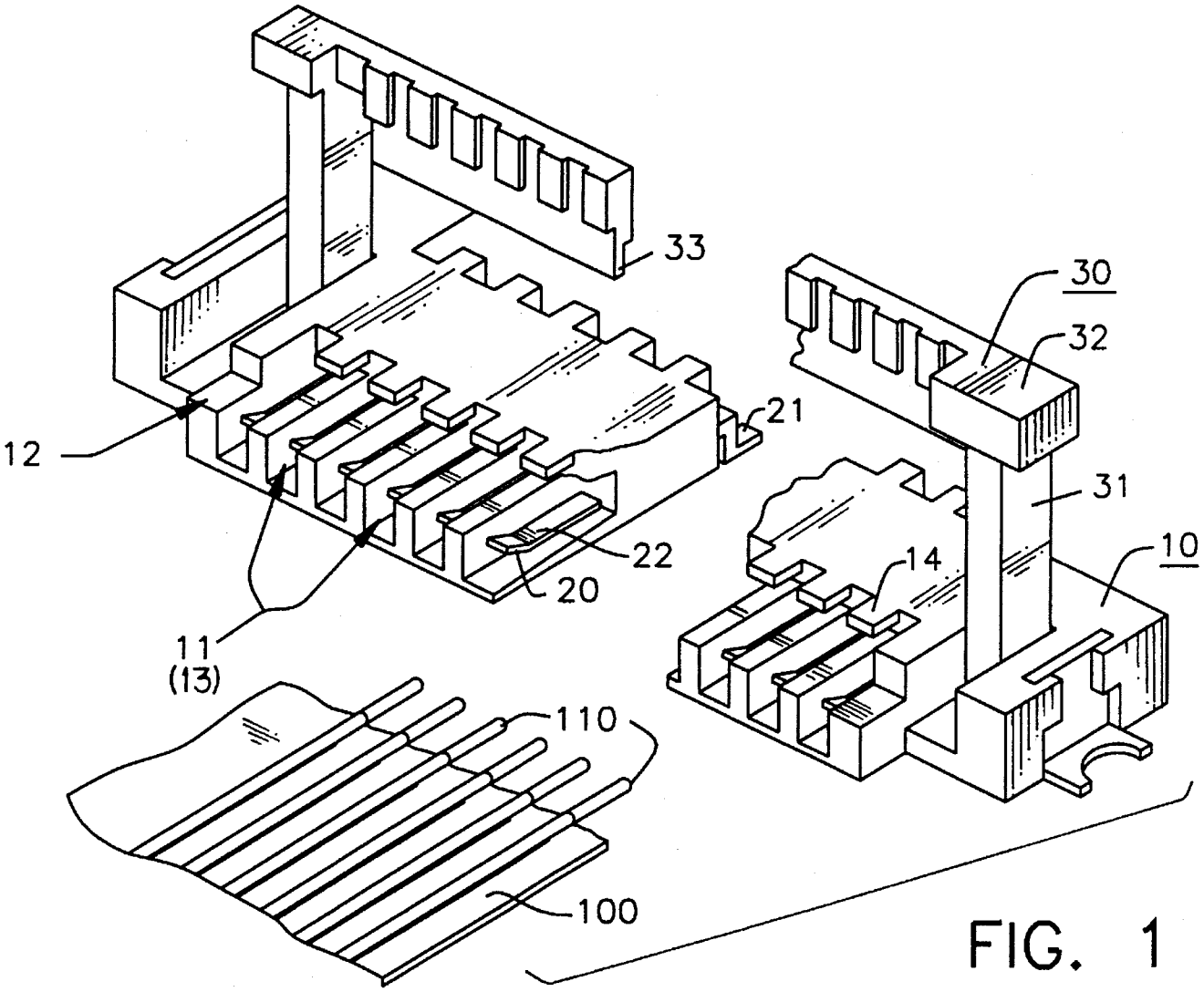
FIG. 1 is a partial cutaway perspective view showing one embodiment of the present invention.

FIG. 1 shows one embodiment of the connector of the present invention. The connector shown in FIG. 1 comprises a body member (housing) 10, contacts 20 mounted inside the body member 10, and a cover member 30 formed to be pivotal with respect to the connector.

The body member 10 has conductor receiving sections 11 for receiving a plurality of conductive end portions 110 of a member to be connected 100. Each conductor receiving section has an opening 12 for placing the conductive end portions of the member to be connected and bringing them into contact with the contacts, and a plurality of grooves 13 formed parallel to each other with spacings corresponding to the member to be connected between them.

Note that a flat cable is illustrated as the member to be connected in the embodiment shown in FIG. 1, but it is also contemplated to use, e.g., a jumper or a printed circuit board.

The contacts 20 are so mounted inside the housing 10 as to project into the conductor receiving sections in order to contact the conductive end portions 110 of the member to be connected. Each contact includes terminal portion 21 extending outwardly from the connector body member, and a portion 22 to be brought into contact with one conductive end portion of the member to be connected. In this embodiment shown in FIG. 1, this contact portion 22 is preferably a leaf spring.

Details of the cover member 30 are described below with reference to FIGS. 2–4.

Figure 2:
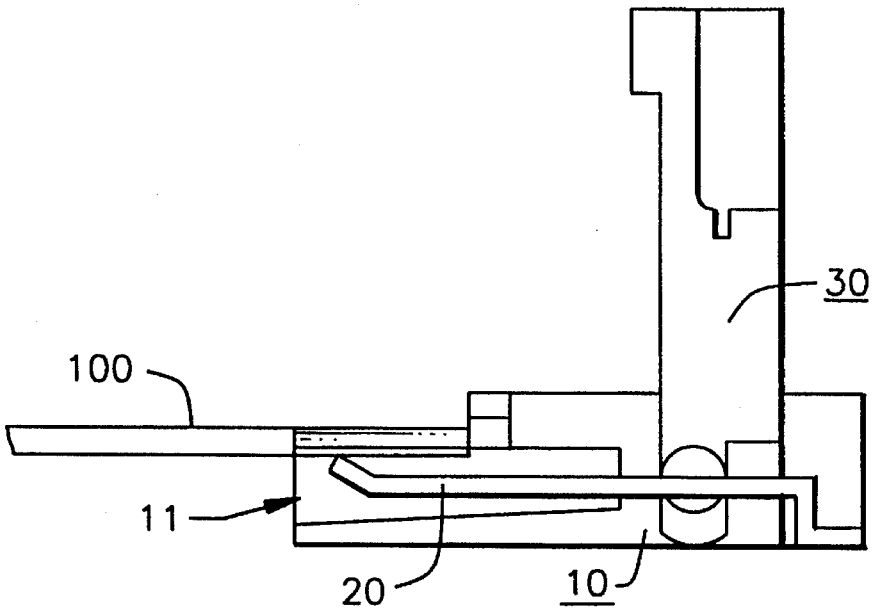
FIG. 2 is a longitudinal sectional view schematically showing the use condition of the connector according to the present invention.
Figure 3:
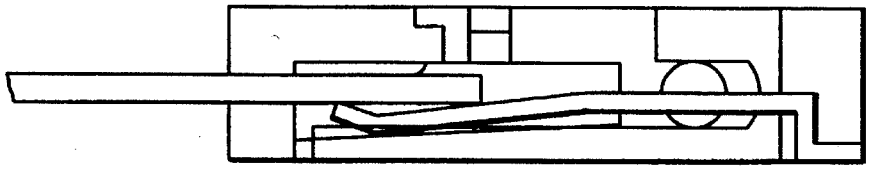
FIG. 3 is a longitudinal sectional view schematically showing the use condition of the connector according to the present invention.
Figure 4:
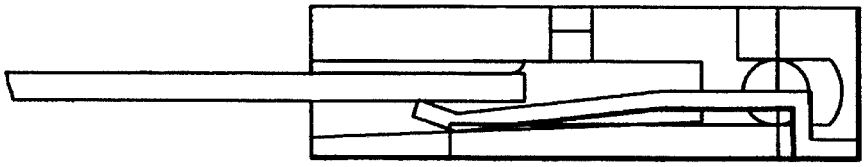
FIG. 4 is a longitudinal sectional view schematically showing the use condition of the connector according to the present invention.

FIGS. 2–4 explains the procedure for connecting the member 100 to be connected (a flat cable 100 is illustrated in FIGS. 2–4) with the connector according to the present invention.

Initially, the cover member 30 is opened at substantially 90° with respect to the connector body member 10, and the conductive end portions 110 of the flat cable 100 are placed in the openings of the conductor receiving sections 11 of the connector. In this state, the end portions of the conductors of the flat cable are so placed as to be aligned with the grooves 13 of the conductor receiving section (see FIG. 2(1)).

Subsequently, by pivoting arm portions 31 of the cover member, cover portion 32 is caused to cover the opening of the conductor receiving section. At the same time, the conductive end portions of the flat cable are brought into contact with the contacts (see FIG. 3).

Thereafter, by sliding the cover portion along the connector body member 10 in a direction parallel to the contacts, a latching ridge 33 (see FIG. 1) formed on the rear surface of the cover portion latches with a protrusion 14 protruding into the opening of the connector body member, while the cover portion covers the conductor receiving section. In this state, the pivot of the cover member is inhibited, so the contact state between the conductive end portions of the flat cable and the contacts is held (see FIG. 4).

In this embodiment shown in FIGS. 1 and 2–4, the conductive end portions of the placed cable and the contacts of the connector are in contact with each other in the state shown in FIG. 2. However, that is not necessarily required. That is, the conductive end portions and the contacts need only be in contact with each other reliably in the states shown in FIGS. 3 and 4.

To remove the cable from the connector, the reverse procedure is followed. That is, the cover member is pulled out along the connector body member in the direction parallel to the contacts to allow the cover member to pivot. Thereafter, the cover member is pivoted to remove the cable from inside the conductor receiving section of the connector.

Figure 5:
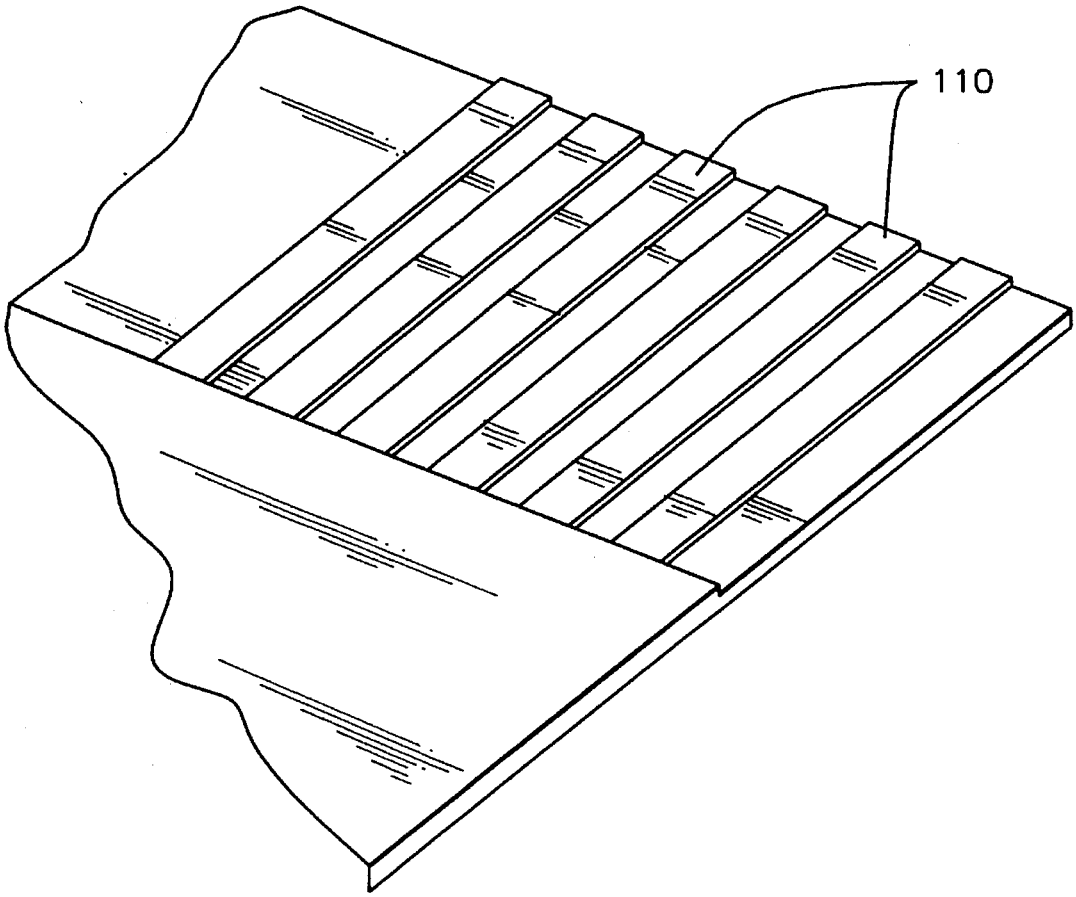
FIG. 5 is a partial perspective view showing another example of a cable to be connected to the connector of the present invention.

FIG. 5 shows a member to be connected whose conductive end portions consist of a plurality of strips of a conductive film or rubber. To connect this member with the connector of the present invention, the member is placed in the opening of the conductor receiving section of the connector with the surface having these conductive end portions facing downward.

In the connector according to the present invention, the conductive end portions of a flat cable are placed into and removed from the opening of the connector (in other words, the conductive end portions are vertically placed in and removed from the connector). Therefore, no excess load is applied on the cable, and no larger force than is needed is applied on the contacts to be brought into contact with the cable. This prevents the cable and the contacts from being broken.

In addition, the cover member is reliably locked into the counterpart of the connector by sliding the cover member along the connector body member. This makes it possible to reliably hold the contact state between the cable and the contacts.

Furthermore, the insertion and removal of the cable with respect to the contacts can be readily performed by the above operations, resulting in an extremely superior operability.

Having described the preferred invention herein, it should be appreciated that variations thereof may be made thereto without departing from the contemplated scope of the invention. Thus, the preferred embodiments described herein are considered illustrative rather than limiting. The true scope of the invention is set forth in the claims appended hereto.

I claim:

1. A connector comprising a body (10) having conductor receiving sections (11) for receiving a plurality of conductive end portions of an inserted member (100);

a plurality of contacts (20) being mounted on said body and projecting into said conductor receiving sections for making contact with the end portions of said inserted member; and, a pivotable cover member (30) for covering said contacts and the conductive end portions of said inserted member and maintaining contact therebetween, said conductor receiving sections being provided with openings (12) through which the end portions of said inserted member are placed for contacting said contacts, said cover member pivoting to cover said openings (12) and said cover member in its entirety sliding relative to said contacts with the openings covered to thereby latch with said body.

2. A connector according to claim 1, wherein said conductor receiving sections comprise a plurality of grooves (13) arranged mutually in parallel at intervals matching the distances between the end portions of said conductor receiving sections.

3. A connector according to claim 1, wherein each of said contacts comprises a terminal portion (21) extending out from said body, and a leaf spring portion (22) for making contact with the end portions of said inserted member.

4. A connector according to claim 1, wherein said cover member comprises a pair of arm portions (31) and a cover portion (32), each said arm portion being pivotable relative to said body, and said cover portion being slidable in said conductor receiving section, with the openings covered.

5. A connector according to claim 4, wherein said cover portion has a latching ridge (33) at a rear surface thereof which latches with a protrusion (14) extending into the opening of said conductor receiving section when said cover member slides in said conductor receiving section.

* * * * *